US006604345B1

(12) United States Patent
Langemaat

(10) Patent No.: US 6,604,345 B1
(45) Date of Patent: Aug. 12, 2003

(54) APPARATUS FOR APPLYING A BANDEROLE

(75) Inventor: Willem Langemaat, Emmer Compascuum (NL)

(73) Assignee: Sollas Holland B.V., Wormer (NL)

( * ) Notice: Subject to any disclaimer, the term of this patent is extended or adjusted under 35 U.S.C. 154(b) by 0 days.

(21) Appl. No.: 10/018,195

(22) PCT Filed: Jun. 22, 2000

(86) PCT No.: PCT/NL00/00437

§ 371 (c)(1),
(2), (4) Date: Dec. 13, 2001

(87) PCT Pub. No.: WO00/78614

PCT Pub. Date: Dec. 28, 2000

(30) Foreign Application Priority Data

Jun. 23, 1999 (NL) ..... 1012412

(51) Int. Cl.[7] ..... B65B 13/04; B65H 20/00
(52) U.S. Cl. ..... 53/589; 226/94; 226/170
(58) Field of Search ..... 53/589, 582; 226/94, 226/170

(56) References Cited

U.S. PATENT DOCUMENTS 3,068,528 A * 12/1962 Ownes ..... 264/467
3,269,081 A * 8/1966 Anderson ..... 53/460
3,331,312 A * 7/1967 Leslie et al. ..... 100/28
3,466,849 A * 9/1969 Schaefer et al. ..... 53/210
3,528,592 A * 9/1970 White ..... 226/5
3,548,740 A * 12/1970 Kobiella ..... 310/67 R
3,768,396 A * 10/1973 Coleman ..... 100/26
4,211,349 A * 7/1980 van der Wal ..... 226/171
4,272,311 A * 6/1981 D'Angelo et al. ..... 156/215
4,852,820 A * 8/1989 Looser ..... 242/527.2
4,856,769 A * 8/1989 Andrew et al. ..... 271/193
5,560,180 A * 10/1996 Rodriguez et al. ..... 53/399
5,755,084 A * 5/1998 Dekker ..... 53/589
5,964,988 A * 10/1999 LaRose et al. ..... 204/164
6,415,712 B1 * 7/2002 Helland et al. ..... 100/26

FOREIGN PATENT DOCUMENTS

WO WO 00/78614 A1 12/2000

* cited by examiner

*Primary Examiner*—Rinaldi I. Rada
*Assistant Examiner*—Paul Durand
(74) *Attorney, Agent, or Firm*—Jeffrey D. Myers

(57) ABSTRACT

An apparatus for applying a banderole around one or a plurality of products creating an electrostatic attraction between the band material being supplied and the conveyor unit. The conveyor unit is connected to earth potential, and electrodes are positioned in the vicinity of the trajectory to be followed by the band material.

5 Claims, 1 Drawing Sheet

APPARATUS FOR APPLYING A BANDEROLE

CROSS-REFERENCE TO RELATED APPLICATIONS

Figure 1:
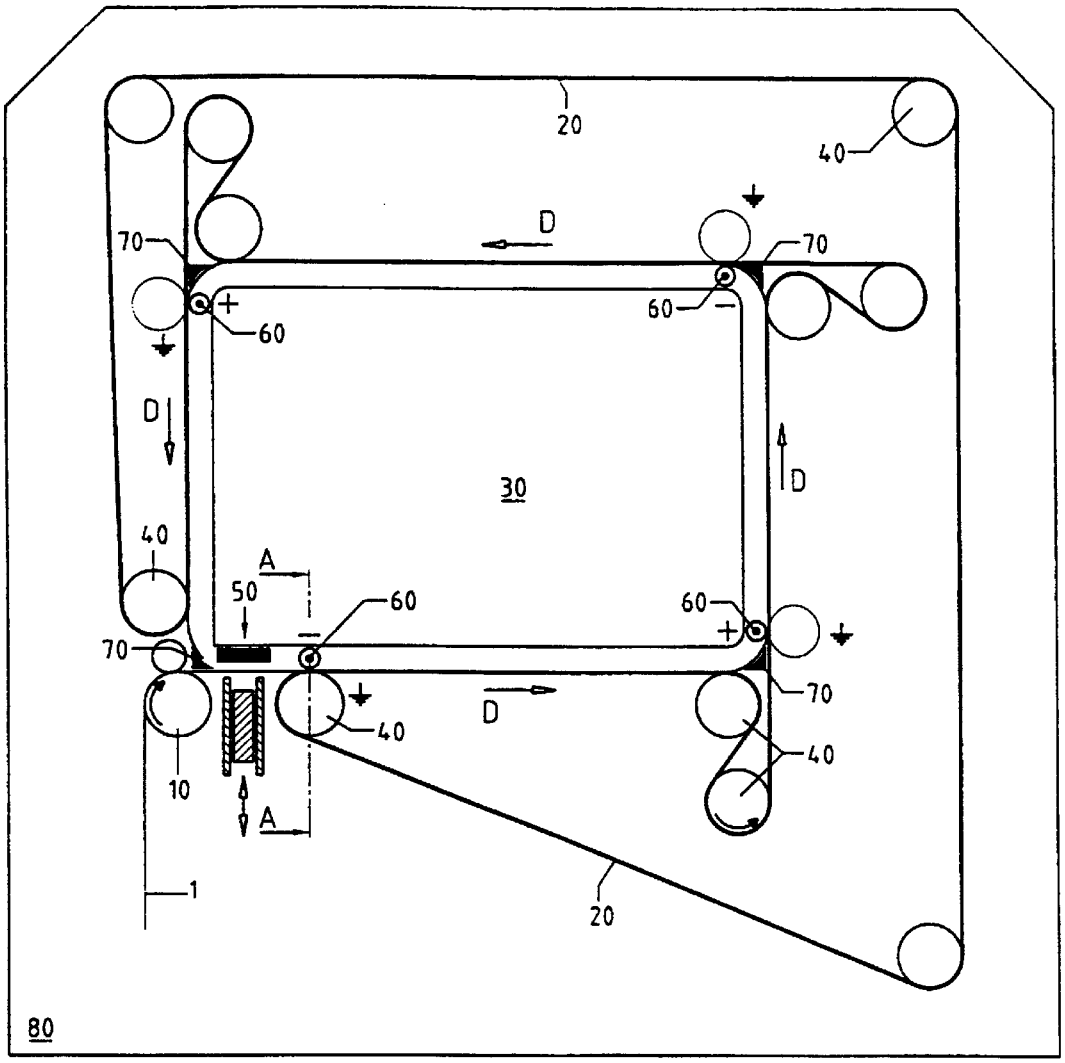

This application is a national entry application of International Patent Application Serial No. PCT/NL00/00437, entitled "Apparatus for Applying a Banderole" to Willem Langemaat having an international filing date of Jun. 22, 2000, and claiming priority to Netherlands Patent Application Serial No. 1012412, having a filing date of Jun. 23, 1999, and the specifications thereof are incorporated herein by reference.

STATEMENT REGARDING FEDERALLY SPONSORED RESEARCH OR DEVELOPMENT (Not Applicable)

INCORPORATION BY REFERENCE OF MATERIAL SUBMITTED ON A COMPACT DISK OR MICROFICHE APPENDIX (Not applicable)

BACKGROUND OF THE INVENTION

1. Field of the Invention

The invention relates to an apparatus for applying a banderole around one or a plurality of products, which banding machine is provided with a feeding mechanism for band material, with a conveyor unit extending at least partly around a product space in which the product or products are contained, and including and cooperating with holding means for causing the band material to adhere to the conveyor unit so that, when in operation, the band material supplied is taken around the product space such as to form a loop of band material around the product space, with cutting means for cutting a portion of the band material applied around the product or the products, and with sealing means for sealing the loop of band material surrounding the product or products.

2. Description of Related Art

Such an apparatus for applying a banderole is disclosed in the European patent publication EP-B-0 741 656. This prior art banding machine is provided with the conveyor unit embodied as conveyor belt, connected with suction means for holding the band material. The suction means comprise a vacuum pump whose suction side is connected with the conveyor belt by means of an under-pressure channel surrounding the conveyor belt. The conveyor belt is provided with openings that are thus in communication with the suction side of the vacuum pump. Due to the pressure difference over the conveyor belt, the band material adheres to the conveyor belt, allowing the conveyor belt to take the band material around the product space. The transport unit may also be formed by a plurality of mutually spaced conveyors cords. However, the force holding the band material to the conveyor unit in the form of the conveyor belt or cords is brought about indirectly by means of pressure difference, and the magnitude of said force, as well as the pressure difference will be determined by the degree of friction between the band material and the conveyor unit. In addition to the friction coefficient between band material and conveyor unit, the degree of friction will also be determined by the contact surface between the conveyor unit and the band material, which contact surface will be limited due to the necessity of openings in the conveyors unit. To allow the prior art banding machine to work properly it is further essential that the sides of the band material join on to the walls of the under-pressure channel. If this is not the case, the pressure difference will decrease, resulting in a reduction in the force holding the band material to the conveyor unit. The necessary presence of openings in the conveyor unit will also increase the elasticity of the conveyor unit. This will result in the occurrence of slip between band material and conveyor unit, involving considerable inaccuracy as the band material is taken around the product space, which is further amplified by the elasticity of the conveyor unit.

BRIEF SUMMARY OF THE INVENTION

WO-A-96/34799 discloses a banding machine of the type mentioned in the preamble, which is provided with means for generating electrostatic attraction between the band material being supplied and the conveyor unit.

In the banding machine according to the invention, the conveyor unit is connected to earth potential and an electrode, connected to a high voltage, is positioned in the vicinity of the trajectory to be followed by the band material. Due to these measures the conveyor unit and the band material receive different charges, generating an electrostatic attraction that causes the band material to adhere to the conveyor unit.

The electrostatic attraction produces a direct holding force causing the band material to adhere to the conveyor unit, the magnitude of the holding force being variable by the degree of electrostatic attraction. The occurrence of slip between the band material and conveyor unit will be extremely unlikely, and the conveyor belt to be used need only possess very little elasticity. As a result the band material can be supplied in very exact amounts so that, for example, a precisely determined length of band material can be applied around a product. This is of particular importance with products that due to a tensile force become deformed in the banderole. Further, due to the greater adhesive force, the rate of conveying the band material around the product space may be increased, allowing the application of a banderole around the product or products to proceed more quickly, and reducing the processing costs.

Preferably the electrode is positioned in the vicinity of the starting point of the trajectory around the product space so that the electrostatic attraction is already effective from this starting point.

In a preferred embodiment the conveyor unit is connected at various positions along the trajectory around the product space to earth potential, and/or is provided with a number of electrodes that are connected to high voltage and are positioned in the vicinity of and distributed over the trajectory around the product space. This is a simple manner for ensuring the electrostatic charge difference between the band material and the conveyor unit over the trajectory around the product space.

In an embodiment of the banding machine in which the trajectory around the product space comprises a plurality of segments, it is preferred for each segment to include at least one electrode, with the electrode(s) of each subsequent segment, viewed in the transport direction of the band material around the product space, having an opposite charge in relation to the electrode(s) of a preceding segment. Practice has proven that in this manner each segment acquires an exceedingly good adhesion between the band material and the conveyor unit. In an optimal situation an electrode is positioned in the vicinity of the starting point of each segment.

Figure 2:
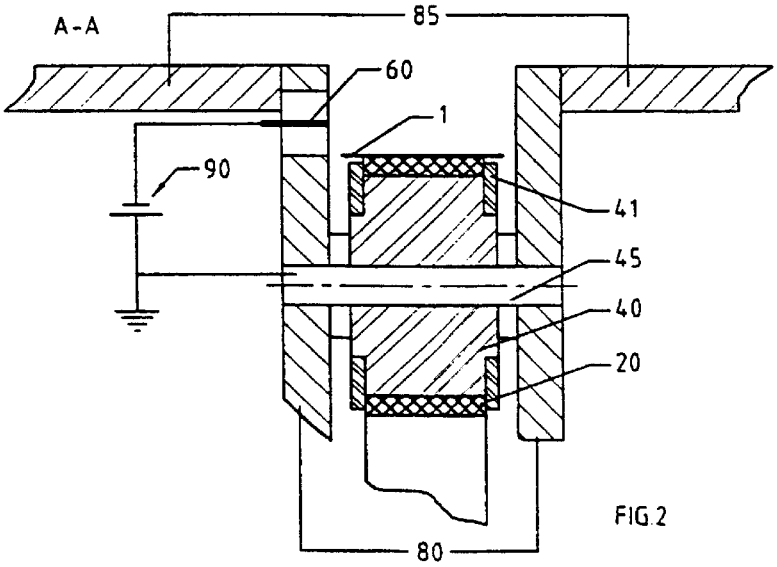

The invention will now be explained in more detail with reference to the accompanying drawing, in which identical reference numbers designate-similar parts, and in which:

FIG. 1, shows a longitudinal cross section of an embodiment of the banding machine according to the invention; and FIG. 2, shows a cross section along the line A—A according to FIG. 1.

DETAILED DESCRIPTION OF THE INVENTION

The longitudinal cross section in FIG. 1 of an embodiment of the banding machine according to the invention shows band material made of, for example, plastic or paper that is supplied by means of a feed mechanism 10 from, for example, a feeding roller (not shown). The band material 1 is fed to an endless conveyor belt 20 as unit for conveying the band material 1 around a product space 30. Guide rollers 40 guide the conveyor belt 20 around the product space 30. It is remarked that not all the guide rollers shown are provided with the reference number 40. The band material 1 is taken by the conveyor belt 20 in the direction of the arrows D over a trajectory around the product space 30, until the end of the band material reaches a mechanism 50, by means of which the end of the band material 1 can be held. The conveyor belt 20 and the guide rollers 40 are mounted between two parallel walls 80. A detail of this is shown in FIG. 2. One or several of the guide rollers 40 are driven by a motor (not shown in the Figures) connected with a control. A motor that is not shown also drives the feed mechanism 10.

A product or several stacked products (not shown in the Figures) may be introduced into the product space 30. When the band material has been taken around the product space and its ends are held by the mechanism 50, the rotation direction of the feed mechanism 10, and optionally of the conveyor belt 20, are reversed. The band material 1 will, at least at the sides and top of the product space 30, become detached from the conveyor belt 20 and, due to the fact that the end of the band material 1 is held by the mechanisms 50, will become tightened around the product or products. After completion of this process, the portion of the band material 1 applied around the product or products is cut by means of a cutter incorporated in the mechanisms 50 such that the two ends of the portion of band material 1 surrounding the product or products overlap, after which the two ends can, for example, be welded together by means of sealing means incorporated in the mechanism 50. The product or products are thus provided with a banderole made from the band material 1 and may be conveyed from the product space 30, after which a following cycle may commence.

When the band material 1 is supplied by the feed mechanism 10, one end of the band material 1 is brought near the conveyor belt 20 in order to be taken over the trajectory around the product space 30. At the beginning of this trajectory, an electrode 60 is provided in the vicinity of the trajectory. In the exemplary embodiment shown, said electrode 60 is put on a negative high voltage as indicated by the minus sign in FIG. 1. The guide roller 40 for the conveyor belt 20, which is located in the vicinity of said electrode 60, is connected with earth potential, as indicated by an earthing sign in FIG. 1, so that the conveyor belt 20 is also connected with earth potential. As a result, opposite, attracting electrostatic charges will now be applied to the conveyor belt 20 and the band material 1, effectuating an electrostatic attraction between the supplied band material 1 and the conveyor belt 20. The band material 1 thus adheres to the conveyor belt 20, whereby the conveyor belt 20 takes the band material 1 with.

The materials used for the band material 1 and the conveyor belt 20 have to be selected for their suitability to sustain an electrostatic charge. In the embodiments illustrated, the band material 1 and the conveyor belt 20 comprise materials with electrically insulating properties such as, for example, plastic, paper and rubber.

In the embodiments illustrated, the trajectory around the product space 30 is formed by four segments: in succession a horizontal lower first segment, a vertical second segment, a horizontal upper third segment, and a vertical fourth segment. Successive segments are somewhat spaced out, forming (in the exemplary embodiment shown) a corner of 90°. These corners are provided with permanent corner guides 70 for the band material 1.

At the same time, the corner guides 70 loosen the band material 1 from the conveyor belt 20 to allow transfer to a following segment. This is only schematically shown in FIG. 1. In order to achieve for each segment an exceptionally good adhesion between the band material 1 and the conveyor belt 20, an electrode 60 is placed at the beginning of a following segment, connected with a high voltage having an opposite charge to that of the high voltage of the electrode 60 belonging to the preceding segment. In FIG. 1, a plus or minus sign indicates whether an electrode is connected to a positive or negative high voltage. In the vicinity of the electrode of each segment a guide roller 40 is provided for the conveyor belt 20, which guide roller 40 is earthed. In FIG. 1, this is indicated by means of an earthing sign.

In the embodiment illustrated, the mechanism 50 and the feed mechanism 10 are arranged at the left under the product space 30. Alternatively it is possible to position the same approximately in the middle under the product space 30. The horizontal lower portion of the trajectory around the product space 30, will then consist of two different segments each of which possibly having its own electrode and earthed guide roller for the conveyor belt 20.

FIG. 2, shows a cross section along the line A—A according to FIG. 1. The Figure shows two parallel walls 80 between which the various guide rollers 40 and the conveyor belt. 20 are arranged. In FIG. 2 only one guide roller 40 is visible. A table 85 is connected with the side walls 80, on which the product or products can be placed. In FIG. 2, the conveyor belt 20 is shown to run round the guide roller 40 and at its upper side the band material 1 can be seen.

One of the side walls 80 is provided with an opening for an electrode 60. The electrode 60 shown is connected with a negative pole of a schematically represented high voltage source 90, whose positive pole which is connected with the earth potential, is connected with the axle 45 of the guide roller 40, which axle 45 is electrically connected to the guide roller 40. Both the guide roller 40 connected with the earth potential, and its axle 45 are made of electrically conductive material. The sides 41 of said guide roller 40 enclosing the conveyor belt are made of an insulating material.

High voltage sources are generally known in the field of technology and will not be further explained. In practice, a high a voltage source 90 having a high voltage in the order of 20 kV has been shown to suffice. Depending on the specific application, it is possible to choose a high voltage of another order. Since no, or hardly any electrical current will be passing, a voltage source 90 of a low capacity may be chosen. This is also preferable with a view to safety.

The above-described embodiment should not be understood to limit the invention. The banding machine according to the invention can be realized in a diversity of embodiments, all within the scope of the claims. One possible variant within the framework of the invention is a banding machine that is equipped such that during operation the band material being supplied is earthed and that an electrode connected with a high voltage is positioned in the vicinity of the conveyor belt.

What is claimed is:

1. A banding machine apparatus for applying a banderole around one or a plurality of products, comprising a feeding mechanism for band material with a conveyor unit extending at least partly around a product space in which the product or products are contained and including and cooperating with holding means for causing the band material to adhere to the conveyor unit so that, when in operation, the band material supplied is taken around the product space to form a loop of band material around the product space, cutting means for cutting a portion of the band material applied around the product or the products, sealing means for sealing the loop of band material surrounding the product or products, wherein means are provided for generating electrostatic attraction between the band material being supplied and the conveyor unit, and wherein the conveyor unit is connected to an earth potential, and a plurality of electrodes connected to one or more voltages are positioned in the vicinity of and distributed over a trajectory around the product space to be followed by the band material, and wherein the trajectory around the product space comprises a plurality of segments, and wherein each said segment includes an electrode, and wherein the electrode of each segment has an opposite charge in relation to said electrodes in adjacent segments.

2. An apparatus for applying a banderole according to claim 1, wherein one of said electrodes is positioned in the vicinity of the starting point of the trajectory around the product space.

3. An apparatus for applying a banderole according to claim 2, wherein said conveyor unit is connected to the earth potential at various positions along the trajectory around the product space.

4. An apparatus for applying a banderole according to claim 1, wherein said unit is connected to the earth potential at various positions along the trajectory around the product space.

5. An apparatus for applying a banderole according to claim 1, wherein one of said electrodes is positioned in the vicinity of the starting point of each segment.

* * * * *